US011873151B1

(12) United States Patent
Frankis

(10) Patent No.: US 11,873,151 B1
(45) Date of Patent: Jan. 16, 2024

(54) CUSTOMIZABLE PRODUCT PACKAGE AND A METHOD OF FORMING THE SAME

(71) Applicant: Michael Frankis, Palm Springs, CA (US)

(72) Inventor: Michael Frankis, Palm Springs, CA (US)

( * ) Notice: Subject to any disclaimer, the term of this patent is extended or adjusted under 35 U.S.C. 154(b) by 0 days.

(21) Appl. No.: 17/956,749

(22) Filed: Sep. 29, 2022

Related U.S. Application Data

(60) Provisional application No. 63/250,939, filed on Sep. 30, 2021.

(51) Int. Cl.

| | |
|---|---|
| ***B65D 81/03*** | (2006.01) |
| ***B65B 55/20*** | (2006.01) |
| ***B65B 53/02*** | (2006.01) |
| ***B65D 75/00*** | (2006.01) |

(52) U.S. Cl.
CPC ..... *B65D 81/03* (2013.01); *B65B 53/02* (2013.01); *B65B 55/20* (2013.01); *B65D 75/004* (2013.01)

(58) Field of Classification Search
CPC ... B65B 55/02; B65B 2307/736; B65D 53/02; B65D 55/20; B65D 81/03
See application file for complete search history.

(56) References Cited

U.S. PATENT DOCUMENTS

| | | | |
|---|---|---|---|
| 3,734,273 | A | 5/1973 | Watanabe |
| 4,884,385 | A | 12/1989 | Mushinski et al. |
| 5,147,040 | A | 9/1992 | Koike et al. |
| 5,248,547 | A | 9/1993 | Wilson |
| 5,491,017 | A | 2/1996 | Todt |

(Continued)

FOREIGN PATENT DOCUMENTS

| | | | | |
|---|---|---|---|---|
| EP | 1188554 | A2 * | 3/2002 | ..... B32B 27/14 |
| EP | 2733076 | A1 * | 5/2014 | ..... B65B 11/00 |

(Continued)

OTHER PUBLICATIONS

"Inside Amazon's quest to use less cardboard", Fast Company Website, Web page <https://www.fastcompany.com/90564818/inside-amazons-quest-to-use-less-cardboard>, 19 pages, dated Oct. 19, 2020, retrieved from www.fastcompany.com website on May 27, 2023.

(Continued)

*Primary Examiner* — Eyamindae C Jallow
(74) *Attorney, Agent, or Firm* — The Law Office of Patrick F. O'Reilly III, LLC

(57) ABSTRACT

A customizable product package and a method of forming the same are disclosed herein. The customizable product package includes a first layer of wrapping material, at least a portion of the first layer of wrapping material configured to be disposed against an object, the first layer of wrapping material configured to protect the object and provide a packaging base layer; a second layer of inner fill material, the second layer of inner fill material adhered to the first layer of wrapping material by an adhesive agent, the second layer of inner fill material configured to provide a cushioning layer so as to further protect the object; and a third layer of outer wrapping material, the third layer of outer wrapping material compressing the second layer of inner fill material and forming a generally smooth box-like exterior suitable for shipping the object.

8 Claims, 4 Drawing Sheets

(56) References Cited

U.S. PATENT DOCUMENTS

| | | | | |
|---|---|---|---|---|
| 5,736,231 | A | 4/1998 | Todt | |
| 6,696,120 | B1 | 2/2004 | Todt | |
| 6,775,956 | B1 | 8/2004 | Lacey | |
| 6,875,712 | B2 | 4/2005 | Todt | |
| 9,725,198 | B2 | 8/2017 | Whang et al. | |
| 10,287,048 | B2 | 5/2019 | Sytema et al. | |
| 2006/0138013 | A1 | 6/2006 | Lamstein | |
| 2016/0137398 | A1* | 5/2016 | Lemke | B65D 77/02 206/391 |
| 2017/0101246 | A1* | 4/2017 | Merrell | B65D 77/0413 |
| 2021/0376417 | A1* | 12/2021 | Yoshino | B32B 15/085 |

FOREIGN PATENT DOCUMENTS

| | | | | |
|---|---|---|---|---|
| EP | 3666668 | B1 | 7/2021 | |
| WO | WO-2019142172 | A1 * | 7/2019 | B65D 71/0085 |

OTHER PUBLICATIONS

"Fit-to-size automated packing machine saves on shipping costs", Packaging World Website, Web page <https://www.packworld.com/news/e-commerce/article/13372478/fittosize-automated-packing-machine-saves-on-shipping-costs>, 14 pages, dated Apr. 29, 2017, retrieved from www.packworld.com website on May 27, 2023.

"CVP-500 by Neopost Shipping a revolutionary 'Fit to Size' Automated Parcel Creator", Warehouse & Logistics News Website, Web page <https://warehousenews.co.uk/2016/08/cvp-500-by-neopost-shipping-a-revolutionary-fit-to-size-automated-parcel-creator/>, 9 pages, dated Aug. 28, 2016, retrieved from warehousenews.co.uk website on May 27, 2023.

* cited by examiner

CUSTOMIZABLE PRODUCT PACKAGE AND A METHOD OF FORMING THE SAME

CROSS-REFERENCE TO RELATED APPLICATIONS

This patent application claims priority to, and incorporates by reference in its entirety, U.S. Provisional Patent Application No. 63/250,939, entitled "Customizable Product Package And A Method Of Forming The Same", filed on Sep. 30, 2021.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a customizable product package and a method of forming the customizable product package. More particularly, the invention relates to a customizable product package that includes a plurality of layers applied directly onto items for shipping and storage so as to obviate the need for a conventional cardboard box.

2. Background

Most items sold online directly to consumers are shipped in a corrugated cardboard box. Because there are a limited number of sizes of cardboard boxes that are available, most online shoppers have made a purchase and have received the product in an inappropriately large box. It is estimated that as much as 70% of the volume shipped for e-commerce sales comprises the air space in the shipping boxes. The use of cardboard boxes having a limited number of standardized sizes causes many problems, such as: (i) an increase in shipping cost through use of larger than necessary packages, (ii) an increase in packaging costs through use of over-sized cartons and filling materials (e.g., packing peanuts, paper, etc.), (iii) negative environmental impact through increased carbon footprint generated through shipment of over-sized packages, and (iv) negative environmental impact through over use of disposable packaging products.

Therefore, what is needed is a customizable product package and a method of forming the same that replaces a standardized cardboard shipping carton with a custom-sized, variable thickness covering made from a combination of an adhesive and inner fill material, which is compressed between two layers of a wrapping material.

BRIEF SUMMARY OF EMBODIMENTS OF THE INVENTION

Accordingly, the present invention is directed to a customizable product package and a method of forming the same that substantially obviates one or more problems resulting from the limitations and deficiencies of the related art.

In accordance with one or more embodiments of the present invention, there is provided a customizable product package that comprises a first layer of wrapping material, at least a portion of the first layer of wrapping material configured to be disposed against an object, the first layer of wrapping material configured to protect the object and provide a packaging base layer; a second layer of inner fill material, the second layer of inner fill material adhered to the first layer of wrapping material by an adhesive agent, the second layer of inner fill material configured to provide a cushioning layer so as to further protect the object; and a third layer of outer wrapping material, the third layer of outer wrapping material compressing the second layer of inner fill material and forming a generally smooth box-like exterior suitable for shipping the object.

In a further embodiment of the present invention, the first layer of wrapping material comprises a plastic shrink wrap material.

In yet a further embodiment, the second layer of inner fill material is selected from the group consisting of: (i) shredded paper, (ii) shredded cardboard, (iii) recycled plastic, and (iv) a cellulose material.

In still a further embodiment, the third layer of outer wrapping material comprises a plastic heat shrink wrap material.

In accordance with one or more other embodiments of the present invention, there is provided a method of forming a customizable product package, the method comprising the steps of: (i) applying a first layer of wrapping material around an object, at least a portion of the first layer of wrapping material being disposed against the object, and the first layer of wrapping material configured to protect the object and provide a packaging base layer; (ii) applying an adhesive agent and a second layer of inner fill material to the first layer of wrapping material, the second layer of inner fill material configured to provide a cushioning layer so as to further protect the object; and (iii) applying a third layer of outer wrapping material around the second layer of inner fill material so as to cover the second layer of inner fill material, the third layer of outer wrapping material compressing the second layer of inner fill material and forming a generally smooth box-like exterior suitable for shipping the object.

In a further embodiment of the present invention, the step of applying the first layer of wrapping material around the object further comprises shrink wrapping the object using a plastic shrink wrap material without sealing the plastic shrink wrap material.

In yet a further embodiment, the plastic shrink wrap material is selected from the group consisting of: (i) polyvinyl chloride, (ii) polyolefin, and (iii) polyethylene.

In still a further embodiment, the step of applying the adhesive agent and the second layer of inner fill material to the first layer of wrapping material further comprises the sub-steps of: (a) initially spraying the first layer of wrapping material with the adhesive agent and the second layer of inner fill material on exposed sides of the object; (b) lifting the object and compacting the second layer of inner fill material on the exposed sides of the object; (c) after lifting the object, spraying the first layer of wrapping material on the bottom of the object with the adhesive agent and the second layer of inner fill material; (d) rotating the object approximately 90 degrees; and (e) compacting the second layer of inner fill material applied to the bottom of the object.

In yet a further embodiment, the step of applying the adhesive agent and the second layer of inner fill material to the first layer of wrapping material further comprises the sub-steps of: (a) initially spraying the first layer of wrapping material with the adhesive agent; (b) moving the object into a closed container; (c) blowing the inner fill material into the closed container and onto sides of the object containing the adhesive agent so as to form the second layer of inner fill material; and (d) compacting the second layer of inner fill material on the sides of the object.

In still a further embodiment, the step of applying the third layer of outer wrapping material around the second layer of inner fill material further comprises the sub-steps of: (a) applying a plastic shrink wrap material to the second layer of inner fill material; and (b) applying heat to the plastic shrink wrap material so that the plastic shrink wrap material tightly compresses the second layer of inner fill material.

In yet a further embodiment, the plastic shrink wrap material is selected from the group consisting of: (i) polyvinyl chloride, (ii) polyolefin, and (iii) polyethylene.

In still a further embodiment, the method further comprises the step of transporting the object on a conveyor belt so that the first layer of wrapping material, the second layer of inner fill material, and the third layer of outer wrapping material are automatically applied to the object in succession.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 1:
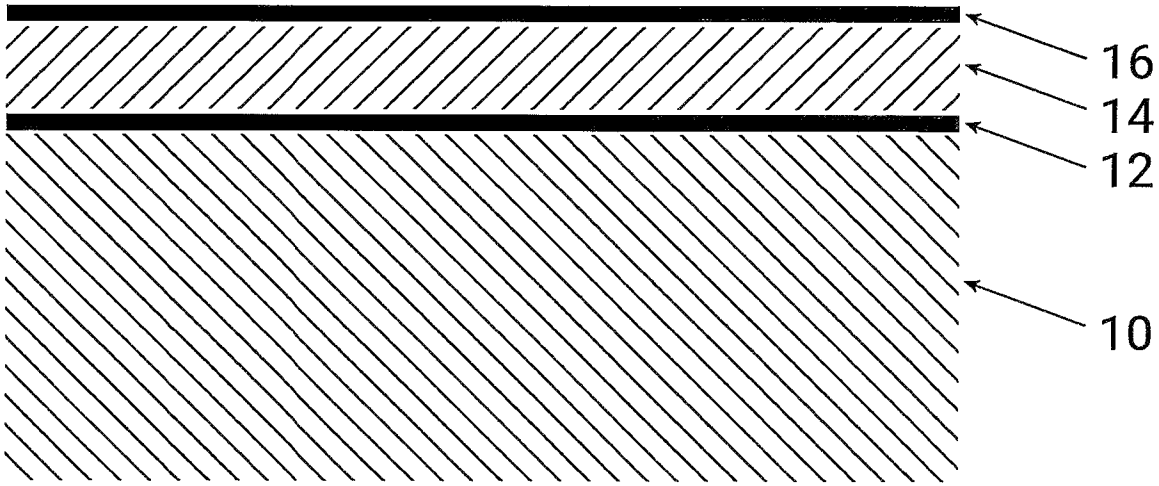
FIG. 1 is an enlarged, partial sectional view cut through a customizable product package disposed around an object, according to an illustrative embodiment of the invention.
Figure 2:
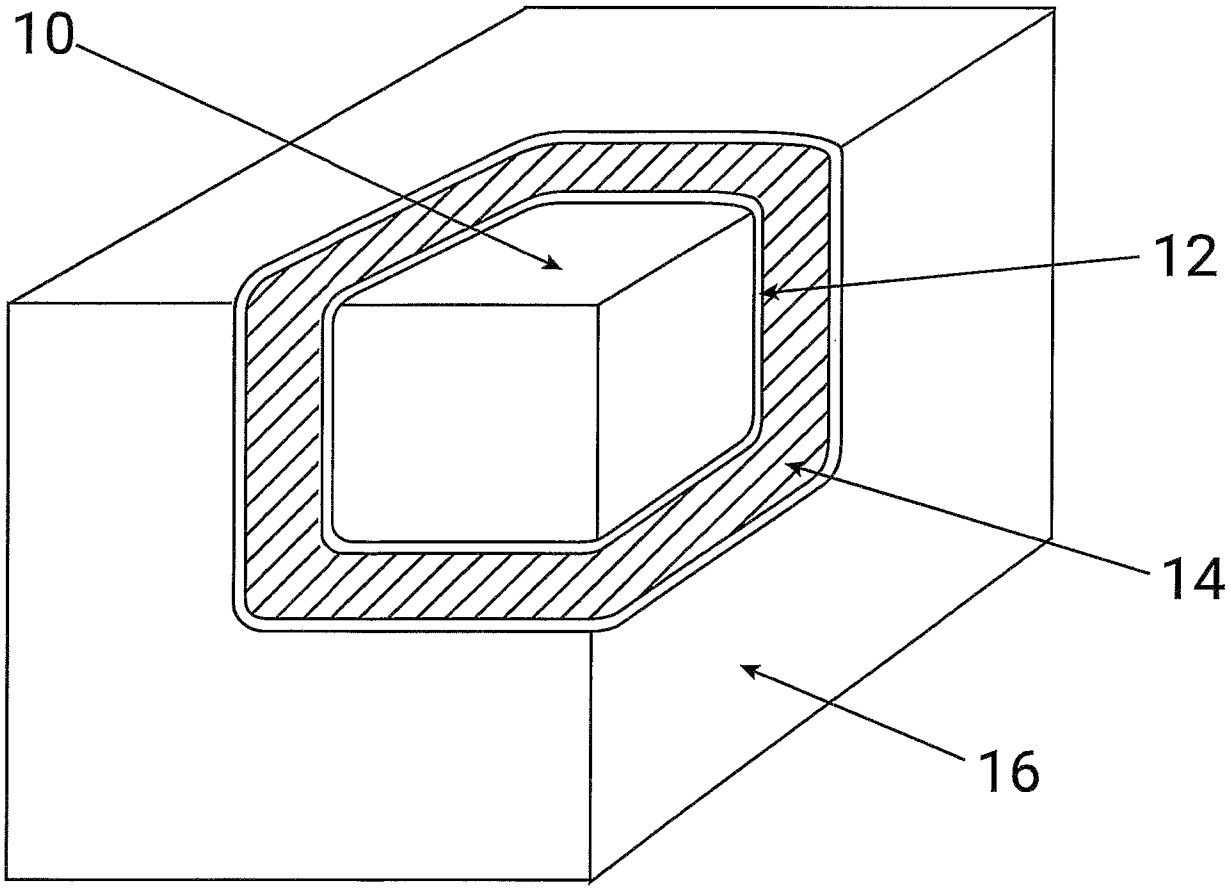
FIG. 2 is a cut-away perspective view of the object wrapped with the customizable product package, according to the illustrative embodiment of FIG. 1.

An illustrative embodiment of a customizable product package is depicted in FIGS. 1 and 2. As shown in these figures, the customizable product package includes a first layer of wrapping material 12, at least a portion of the first layer of wrapping material 12 configured to be disposed against an object 10, the first layer of wrapping material 12 configured to protect the object 10 and provide a packaging base layer; a second layer of inner fill material 14, the second layer of inner fill material 14 adhered to the first layer of wrapping material 12 by an adhesive agent, the second layer of inner fill material 14 configured to provide a cushioning layer so as to further protect the object 10; and a third layer of outer wrapping material 16, the third layer of outer wrapping material 16 compressing the second layer of inner fill material 14 and forming a generally smooth box-like exterior suitable for shipping the object 10.

In the illustrative embodiment, the first layer of wrapping material 12 comprises a plastic shrink wrap material that protects the object from damage resulting from the application of the inner fill material 14. In the illustrative embodiment, the first layer of wrapping material 12 may generally conform to the shape of the object 10 being wrapped without significant air gaps so as to minimize the amount of packaging material that is required, and minimize the overall size of the wrapped object.

In the illustrative embodiment, the second layer of inner fill material 14 is selected from the group consisting of: (i) shredded paper, (ii) shredded cardboard, (iii) recycled plastic (e.g., shredded recycled plastic, ground recycled plastic, or recycled plastic that is otherwise processed into pieces for a fill material), and (iv) a cellulose material (e.g., similar to the cellulose, paper-based material that is used for spray-in insulation in homes). Although, in other embodiments, the second layer of inner fill material 14 may be formed using other suitable materials. In the illustrative embodiment, the thickness of the second layer of inner fill material 14 may be approximately equal to that of a typical corrugated cardboard box (e.g., 3/16").

In the illustrative embodiment, the third layer of outer wrapping material 16 comprises a plastic heat shrink wrap material that provides a generally smooth outer layer acceptable for shipping through carriers, such as the U.S. Postal Service, FedEx, United Parcel Service (UPS), etc.

Now, with combined reference to the diagrams in FIGS. 3 and 4, an illustrative method 100 of forming a customizable product package will be described. In the illustrative embodiment, the method comprising the steps of: (A) applying a first layer of wrapping material 104 around an unwrapped object 102, at least a portion of the first layer of wrapping material 104 being disposed against the object 102, and the first layer of wrapping material 104 configured to protect the object 102 and provide a packaging base layer; (B) applying an adhesive agent (e.g., a glue) and a second layer of inner fill material 108, 112 to the first layer of wrapping material 104, the second layer of inner fill material configured to provide a cushioning layer so as to further protect the object; and (C) applying a third layer of outer wrapping material 120 around the second layer of inner fill material so as to cover the second layer of inner fill material, the third layer of outer wrapping material 120 compressing the second layer of inner fill material and forming a generally smooth box-like exterior suitable for shipping the object 102.

In the illustrative embodiment, the step of applying the first layer of wrapping material 104 around the object 102 further comprises shrink wrapping the object 102 using a plastic shrink wrap material without sealing the plastic shrink wrap material 106 (i.e., no heat is applied to the inner layer of plastic shrink wrap so that the object is able to be more easily removed from the packaging by the customer). In the illustrative embodiment, the plastic shrink wrap material 104 is selected from the group consisting of: (i) polyvinyl chloride, (ii) polyolefin, and (iii) polyethylene.

Figure 4:
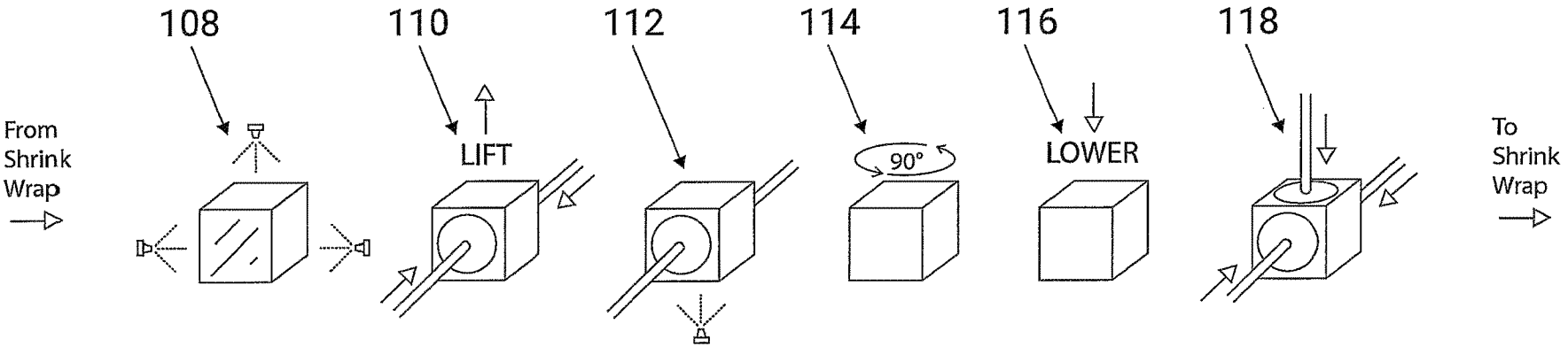
FIG. 4 is a diagrammatic perspective view of the exemplary process for applying the adhesive and inner fill material of the customizable product package, according to the illustrative embodiment of FIG. 3.

In the illustrative embodiment, with particular reference to the diagram of FIG. 4, the step of applying the adhesive agent and the second layer of inner fill material to the first layer of wrapping material further comprises the sub-steps of: (a) initially spraying 108 the first layer of wrapping material with the adhesive agent and the second layer of inner fill material on exposed sides of the object; (b) lifting 110 the object and compacting the second layer of inner fill material on the exposed sides of the object; (c) after lifting the object, spraying 112 the first layer of wrapping material on the bottom of the object with the adhesive agent and the second layer of inner fill material; (d) rotating 114 the object approximately 90 degrees; (e) lowering 116 the object back onto the conveyor belt 128; and (f) compacting 118 the second layer of inner fill material applied to the bottom of the object.

In an alternative embodiment, the step of applying the adhesive agent and the second layer of inner fill material to the first layer of wrapping material further comprises the sub-steps of: (a) initially spraying the first layer of wrapping material with the adhesive agent; (b) moving the object into a closed container; (c) blowing the inner fill material into the closed container and onto sides of the object containing the adhesive agent so as to form the second layer of inner fill material; and (d) compacting the second layer of inner fill material on the sides of the object. In this alternative embodiment, the loose inner fill material is air blown into the container in which object is disposed, and then the loose inner fill material adheres to the sides of the object containing the adhesive agent (i.e., the loose inner fill material is adhered to the sides of object using a fluidized bed-type application method).

Figure 3:
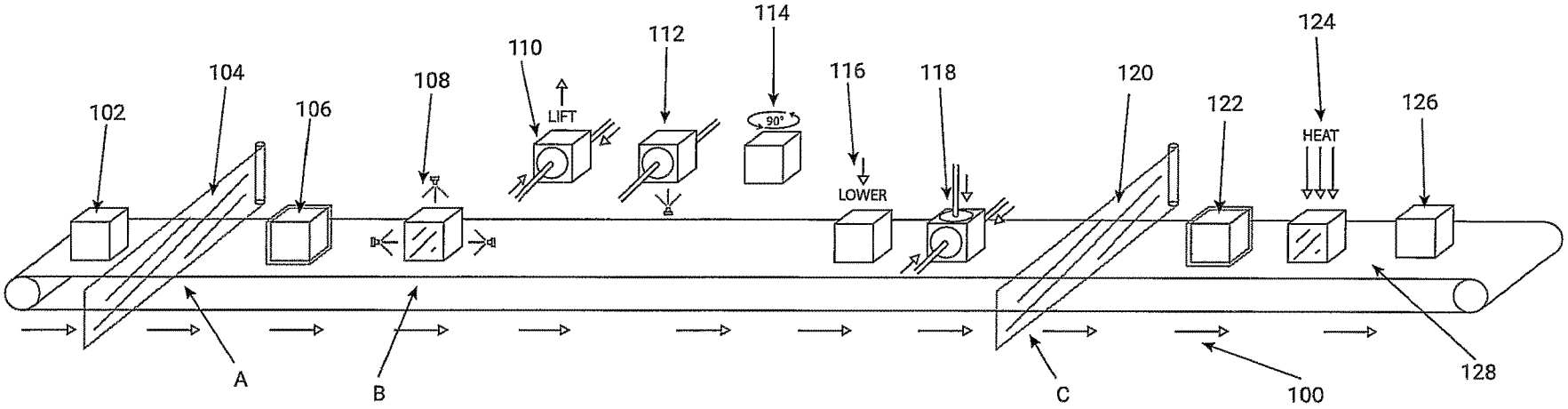
FIG. 3 is a diagrammatic perspective view of an exemplary method for forming the customizable product package, according to an illustrative embodiment of the invention.

Turning again to the illustrative embodiment of FIG. 3, the step of applying the third layer of outer wrapping material around the second layer of inner fill material further comprises the sub-steps of: (a) applying a plastic shrink wrap material 120 to the second layer of inner fill material; and (b) applying heat 124 to the plastic shrink wrap material 120 so that the plastic shrink wrap material 120 tightly compresses the second layer of inner fill material. In the illustrative embodiment, the plastic shrink wrap material 120 is selected from the group consisting of: (i) polyvinyl chloride, (ii) polyolefin, and (iii) polyethylene.

In the illustrative embodiment, as shown in FIG. 3, the object 102 is transported on a conveyor belt 128 so that the first layer of wrapping material, the second layer of inner fill material, and the third layer of outer wrapping material are automatically applied to the object 102 in succession. Although, in other embodiments, the customizable product package may be formed without transporting the object 102 on a conveyor belt.

Referring again to the illustrative embodiment of FIGS. 3 and 4, the steps of the illustrative method will be summarized. First, as shown in FIG. 3, the unwrapped object 102 is wrapped with the plastic shrink wrap material 104, which protects the object and keeps the object dry. Then, the wrapped, but unsealed object 106 (i.e., the loosely wrapped object 106) proceeds down the conveyor belt 128 for the application of the adhesive agent and the inner fill material. With combined reference to FIGS. 3 and 4, the object is first coated on all available/accessible sides in step 108 with the adhesive agent and the inner fill material (i.e., the mulch). Then, the object is pressed and lifted on two sides (e.g., by one or more lifting arms) and the inner fill material is compacted in step 110. This compresses the inner fill material, and gives access to the bottom side. After which, the object is sprayed from the bottom in step 112 to cover the side of the package that was previously resting on the conveyor belt 128 (i.e., the bottom side is sprayed with the mulch). Then, the object is rotated 90 degrees in step 114, and lowered in step 116 back onto the conveyor belt 128. After being lowered, other portions of the inner fill material of the object are compacted in step 118 (i.e., the object is compressed from the top and sides). Turning back to just FIG. 3, the inner fill material of the object is wrapped 122 with the plastic shrink wrap material 120. Then, the outer plastic shrink wrap material 120 is heated in step 124 so as to compress the outer plastic shrink wrap material 120 tightly against the inner fill material layer so as to contain the inner fill material. Finally, at the end of the process, the packaged object 126 is ready for shipping to the customer or storing at a warehouse.

In the illustrative embodiment, the adhesive agent and the shredded inner fill material may be applied to the wrapped object by a variety of different methods, such as: (i) alternate spraying of adhesive and shredded material, (ii) use of a solid/liquid spray nozzle, or (iii) spraying of a pre-mixed blend of adhesive and shredded material. Heat may be applied to the dry applied mix, if necessary.

In the illustrative embodiment, the wrapping may be applied to the object in a conveyer tunnel system comprising of an initial shrink wrap process, followed by application of adhesive and shredded material mix with a spray apparatus, and then followed by a final heat shrink wrap process. In one or more embodiments, the initial shrink wrap process and the final heat shrink wrap may be applied using two (2) shrink wrap tunnels.

It is readily apparent that the aforedescribed customizable product package and method of forming the same offer numerous advantages. In particular, the benefits of the customizable product package described above may include: (i) a reduction in dollar cost of shipping through reduction in package volume, (ii) a reduction in packaging costs through elimination of packing tape and internal filler products, such as foam packing peanuts, bubble wrap, paper, etc., (iii) positive environmental impact through reduction in carbon footprint gained by shipment of lower volume packaging, (iv) positive environmental impact through reduction in use of packaging, and (v) simple use for recycled paper and cardboard to make the shredded material.

Advantageously, the customizable product package described above is able to replace a conventional cardboard shipping carton with a nearly exact-sized, variable thickness covering made from a combination of adhesive and shredded paper and/or cardboard, compressed between two layers of heat shrink wrap film. The exemplary process described above applies wrapping directly onto items for shipping and storage. This exemplary three-layer process applies a combination of adhesive and shredded paper and/or shredded cardboard between two layers of a plastic shrink wrap material.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A method of forming a customizable product package, the method comprising the steps of:

applying a first layer of wrapping material around an object, at least a portion of the first layer of wrapping material being disposed against the object, and the first layer of wrapping material configured to protect the object and provide a packaging base layer;

applying an adhesive agent and a second layer of inner fill material to the first layer of wrapping material, the second layer of inner fill material configured to provide a cushioning layer so as to further protect the object; and applying a third layer of outer wrapping material around the second layer of inner fill material so as to cover the second layer of inner fill material, the third layer of outer wrapping material compressing the second layer of inner fill material and forming a generally smooth box-like exterior suitable for shipping the object.

2. The method according to claim 1, wherein the step of applying the first layer of wrapping material around the object further comprises shrink wrapping the object using a plastic shrink wrap material without sealing the plastic shrink wrap material.

3. The method according to claim 2, wherein the plastic shrink wrap material is selected from the group consisting of: (i) polyvinyl chloride, (ii) polyolefin, and (iii) polyethylene.

4. The method according to claim 1, wherein the step of applying the adhesive agent and the second layer of inner fill material to the first layer of wrapping material further comprises the sub-steps of:

initially spraying the first layer of wrapping material with the adhesive agent and the second layer of inner fill material on exposed sides of the object;

lifting the object and compacting the second layer of inner fill material on the exposed sides of the object;

after lifting the object, spraying the first layer of wrapping material on the bottom of the object with the adhesive agent and the second layer of inner fill material;

rotating the object approximately 90 degrees; and compacting the second layer of inner fill material applied to the bottom of the object.

5. The method according to claim 1, wherein the step of applying the adhesive agent and the second layer of inner fill material to the first layer of wrapping material further comprises the sub-steps of:

initially spraying the first layer of wrapping material with the adhesive agent;

moving the object into a closed container;

blowing the inner fill material into the closed container and onto sides of the object containing the adhesive agent so as to form the second layer of inner fill material; and compacting the second layer of inner fill material on the sides of the object.

6. The method according to claim 1, wherein the step of applying the third layer of outer wrapping material around the second layer of inner fill material further comprises the sub-steps of:

applying a plastic shrink wrap material to the second layer of inner fill material; and applying heat to the plastic shrink wrap material so that the plastic shrink wrap material tightly compresses the second layer of inner fill material.

7. The method according to claim 6, wherein the plastic shrink wrap material is selected from the group consisting of: (i) polyvinyl chloride, (ii) polyolefin, and (iii) polyethylene.

8. The method according to claim 1, further comprising the step of:

transporting the object on a conveyor belt so that the first layer of wrapping material, the second layer of inner fill material, and the third layer of outer wrapping material are automatically applied to the object in succession.

* * * * *